United States Patent [19]

Kononov et al.

[11] 4,209,987

[45] Jul. 1, 1980

[54] HYDRAULIC SCREW PRESS DRIVE

[76] Inventors: Ivan V. Kononov, ulitsa Torpedo, 40, kv. 4; Mikhail P. Makushin, ulitsa Oleka Dundicha, 7, kv. 15; Dmitry I. Polukhin, ulitsa Geroev Sibiryakov, 23, kv. 59; Vyacheslav E. Popov, ulitsa Peshestreletskaya, 125, kv. 76; Viktor P. Salov, ulitsa Zhelyabova, 17, kv. 123, all of Voronezh; Jury A. Bocharov, 15 Parkovaya, 18/1, kv. 109, Moscow; Vasily Y. Golovin, ulitsa Mashinostroitelei, 38, kv. 15, Voronezh; Natalya M. Mirskaya, ulitsa Voroshilova, 9a, kv. 46, Chelyabinsk; Stanislav I. Cherny, ulitsa F. Engelsa, 46, kv. 13; Ivan F. Yakovenko, ulitsa Plekhanovskaya, 41, kv. 21, both of Voronezh, all of U.S.S.R.

[21] Appl. No.: 925,758

[22] Filed: Jul. 18, 1978

[51] Int. Cl.[2] ..... F15B 1/02; B30B 1/08

[52] U.S. Cl. ..... 60/413; 100/269 R; 100/270

[58] Field of Search ..... 60/369, 371, 413, 417, 60/418; 100/238, 269 R, 270; 91/61

[56] References Cited

U.S. PATENT DOCUMENTS

| | | | |
|---|---|---|---|
| 1,913,663 | 6/1933 | Ferris | 60/413 |
| 2,573,993 | 11/1951 | Sedgwick | 100/269 R X |

*Primary Examiner*—Edgar W. Geoghegan

*Attorney, Agent, or Firm*—Fleit & Jacobson

[57] ABSTRACT

The drive of a hydraulic screw press comprises a power cylinder connected with the press slide by its movable member. The chamber of the power cylinder communicates with a pneudraulic accumulator provided with a device for its charging. The device comprises a pneudraulic cylinder with a distributor for communicating its under-piston hydraulic chamber alternately with the source of pressure and a low-pressure hydraulic line, and nonreturn valves for communicating the above-piston pneumatic chamber of the pneudraulic cylinder alternately with the pneumatic line and the pneumatic chamber of the pneudraulic accumulator. This ensures self-sufficiency of the drive of each hydraulic screw press, and the required pressure of gas in the pneudraulic accumulator with a comparatively simple design of the device for charging its pneumatic chamber.

4 Claims, 2 Drawing Figures

HYDRAULIC SCREW PRESS DRIVE

FIELD OF APPLICATION

The present invention relates to hydraulic screw presses and more particularly, to the drives of said presses.

DESCRIPTION OF THE PRIOR ART

Known in the prior art are hydraulic screw press drives comprising a power cylinder connected with the press slide by a movable member, the chamber of said cylinder communicating with the low-pressure hydraulic line through a discharge valve while its inlet valve puts said chamber in communication with a pneudraulic accumulator which has a hydraulic chamber communicating with a source of pressure, a pneumatic chamber and a device for charging its pneumatic chamber.

The device for charging the pneumatic chamber of the pneudraulic accumulator in the prior art drives is constituted by a H.P. compressor with an individual motor, or by cylinders filled with a gas under high pressure.

The compressor is a complicated and bulky mechanism and its employment in the drive complicates the design of the press as a whole and its maintenance.

Charging of the pneudraulic accumulator from cylinders fails to ensure the adequate pressure of gas in its pneumatic chamber and, consequently, of the fluid in the drive because the pressure of gas in the cylinders is substantially lower than that required for building up fluid pressure in the press drive. Therefore, charging of the pneudraulic accumulator from the cylinders calls for the use of devices which step up several times the pressure of gas delivered from the cylinders into the pneudraulic accumulator.

BRIEF DESCRIPTION OF THE INVENTION

The main object of the invention resides in providing a drive of a hydraulic screw press which would ensure required gas pressure in the pneudraulic accumulator with a comparatively simple design of the device for charging its pneumatic chamber.

Another object of the invention is to ensure selfsufficiency of the drive of each hydraulic screw press.

These and other objects are achieved by providing a drive of a hydraulic screw press comprising a power cylinder whose movable member is connnected with the press slide and whose chamber communicates with the L.P. hydraulic line through a discharge valve while its inlet valve puts said chamber in communication with a pneudraulic accumulator which has a hydraulic chamber communicating with a source of pressure, a pneumatic chamber and a device for charging said pneumatic chamber wherein, according to the invention, the device for charging the pneumatic chamber of the pneudraulic accumulator comprises a pneudraulic cylinder with a distributor intended to communicate its underpiston hydraulic chamber alternately with a source of pressure and the L.P. hydraulic line, and nonreturn valves for communicating the abovepiston pneumatic chamber of the pneudraulic cylinder alternately with the pneumatic line and the pneumatic chamber of the pneudraulic accumulator.

This design of the charging device ensures the required pressure of gas in the pneudraulic accumulator and the self-sufficiency of the drive of each hydraulic screw press, rules out the use of cumbersome and sophisticated equipment such as compressor, and simplifies servicing of the drive and operation of the press as a whole.

It is expedient that the distributor should incorporate a shutoff valve with a control element, and limit switches connected with the rod of the pneudraulic cylinder and installed at the extreme positions of its free end.

According to the invention, the shutoff valve consists of a hollow body accommodating a closing element which has a circular shoulder on the outer surface, longitudinal channels and an extension located under a liner provided with holes arranged coaxially with the closing element, one of said holes being of a through type to allow for the passage of the extension while the other one has the form of a chamber accommodating a piston installed with a provision for a constant contact with said extension; the above-piston chamber thus formed is in hydraulic communication with the control element whereas the under-piston chamber is vented to the atmosphere. This design of the shutoff valve permits a considerable reduction in its weight and size and ensures reliability in operation.

The provision of longitudinal channels in the closing element provides for intercommunication between the body chambers located above and under the closing element and, as a consequence, relieves the closing element because the pressure built up in the chamber under the closing element acts simultaneously on both faces of said closing element. This reduces considerably the force required for closing the valve and, consequently, the area to which pressure must be applied for closing the valve which also contributes to decreasing the dimensions of the valve and of the drive in which it is incorporated.

It is expedient that the extension of the closing element should have a cross-sectional area smaller than the area of its circular shoulder which, in turn, should be smaller than the piston area which permits bringing to a minimum the difference between the areas of the closing element faces acted upon by the fluid under pressure; as a result, the forces acting on the closing element from its faces are comparatively counterbalanced. This ensures the requisite mobility (manoeuvrability) of the closing element. In addition, the closing pressure in such valves is taken by the piston whose area is considerably smaller than the area taking this pressure in the prior-art valves.

The reduction of the area to which the valve-closing pressure must be applied provides for a considerable decrease in the power required for controlling the valve. This relationship between the areas of the circular shoulder and piston ensures reliable contact of the closing element with the seat and, therefore, tight closing of the valve.

BRIEF DESCRIPTION OF THE DRAWINGS

Given below is a detailed description of one of the probable embodiments of the invention with reference to the accompanying drawings, in which.

DETAILED DESCRIPTION OF THE INVENTION

Figure 1:
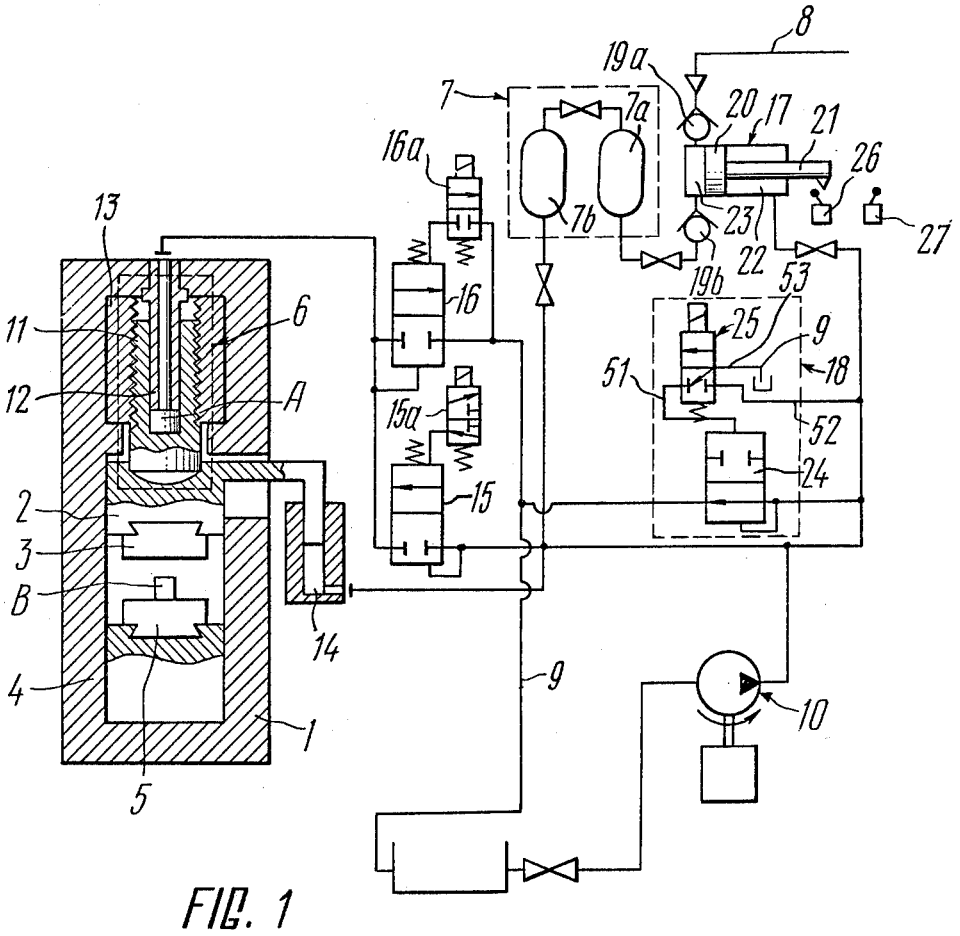
FIG. 1 is a schematic longitudinal section of the hydraulic screw press and a hydrokinematic diagram of its drive according to the invention.

The hydraulic screw press comprises a frame 1 (FIG. 1) accommodating a slide 2 installed with a provision for reciprocating motion and carrying the top die 3. Located under the slide 2 in the frame 1 is a table 4 in which the bottom die 5 is installed. The slide 2 is reciprocated by a drive which comprises a power cylinder 6, a pneudraulic accumulator 7, a pneumatic line 8, a low-pressure hydraulic line 9, and a source of pressure 10.

The movable member of the power cylinder 6, i.e. the barrel 11, is connected with the slide 2 and has a chamber A accommodating a hollow plunger 12 secured in the press frame 1 and functioning as a fixed member of the power cylinder 6. The external cylindrical surface of the barrel 11 is provided with not-self-locking screw thread (the helix angle being larger than the angle of friction) for installing said barrel 11 in a nut 13 secured in the frame. For moving the barrel 11 relative to the nut 13 (working stroke of the slide), the chamber "A" is subjected to the pressure of fluid supplied through the hollow plunger 12 from the pneudraulic accumulator 7.

For returning the barrel 11 of the power cylinder 6 to the initial position, the drive incorporates a plunger-type cylinder 14 whose plunger is connected with the slide 2.

The pneudraulic accumulator 7 has a pneumatic chamber 7*a*, a hydraulic chamber 7*b* constantly communicating with the plunger-type cylinder 14, and a device for charging the pneumatic chamber 7*a* of the pneudraulic accumulator 7. Besides, the hydraulic chamber 7*b* of the pneudraulic accumulator 7 communicates with a source of pressure 10 and, through an inlet valve 15, with the chamber "A" of the power cylinder 6. The inlet valve 15 is provided with a control element 15*a* and may be of any known design suitable for the purpose. The source of pressure 10 is constituted by a high-pressure pump driven by an electric motor. The pump may be of any conventional design suitable for the purpose. The chamber "A" of the barrel 11 of the power cylinder 6 also communicates with the low-pressure line 9 through a discharge valve 16 which is provided with a control element 16*a* of any known design.

The device for charging the pneumatic chamber 7*a* of the pneudraulic accumulator 7 comprises, according to the invention, a pneudraulic cylinder 17 with a distributor 18 and nonreturn valves 19*a* and 19*b*. The pneudraulic cylinder 17 comprises a piston 20 with a rod 21, an under-piston hydraulic chamber 22 communicating alternately with the source of pressure 10 and the low-pressure hydraulic line 9, and an above-piston pneumatic chamber 23 communicating alternately with the pneumatic line 8 and the pneumatic chamber 7*a* of the pneudraulic accumulator 7 through the nonreturn valves 19*a* and 19*b*.

Figure 2:
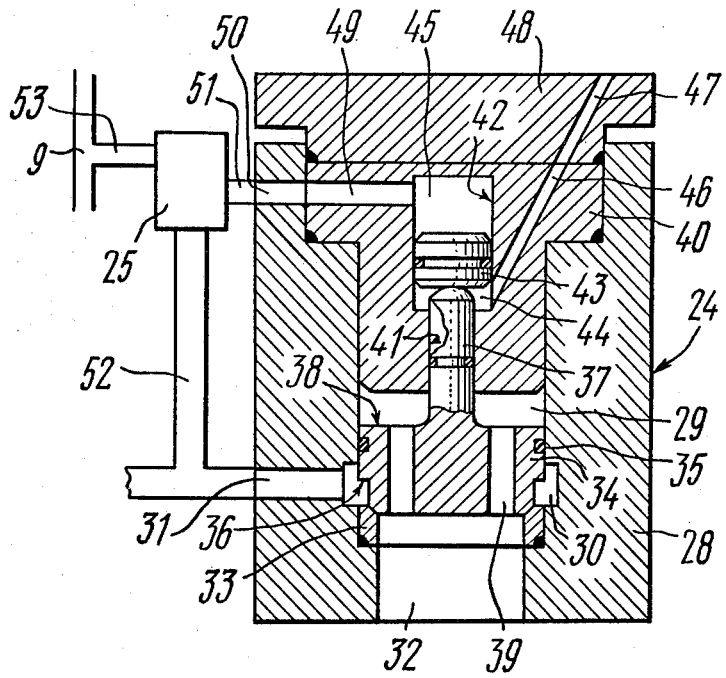
FIG. 2 is a schematic longitudinal section of the valve according to the invention.

According to the invention, the distributor 18 comprises a shutoff valve 24 with a control element 25, and limit switches 26 and 27. The shutoff valve 24 has a body 28 (FIG. 2) in the form of a sleeve whose inside chamber 29 is provided with a circular recess 30. In the side wall of the body 28, level with the recess 30, there is a channel 31 for communicating the recess 30 alternately with the pressure source 10 (FIG. 1) and the low-pressure hydraulic line 9. Besides, in the lower part of the body 28 there is a hole 32 (FIG. 2) through which the chamber 29 of the shutoff valve 24 communicates with the underpiston hydraulic chamber 22 of the pneudraulic cylinder 17. The hole 32 is coaxial with the chamber 29 of the body 28.

The chamber 29 of the body 28 accommodates a seat 33 arranged coaxially with the hole 32, and a control element 34 which bears against the seat 33 and divides the chamber 29 into two parts. The seat 33 has the form of a ring sealed along the face from the side of the closing element 34 which has a chamfer contacting the seat 33. The closing element 34 is installed in the body 28 with a provision for reciprocating therein and has a cylindrical shape whose diameter is equal to the diameter of the inside chamber 29 of the body 28. The cylindrical surface of the closing element 34 is provided with a recess for the seal 35 and a circular shoulder 36 made level with the circular recess 30. Besides, the closing element 34 has an extension 37 located at the side of its face 38 directed away from the hole 32. The cross-sectional area of the extension 37 is smaller than the area of the circular shoulder 36. The face of the extension is shaped like a convex hemisphere.

The closing element 34 is provided with longitudinal channels 39 which intercommunicate the parts of the chamber 29 located above and under the closing element 34. Installed immovably in the chamber 29 of the body 28 above the closing element 34 is a liner 40 which has two holes 41 and 42 arranged one above the other coaxially with the closing element 34.

The hole 41 is of the through type permitting the passage of the extension 37. The hole 42 is made in the form of a chamber whose diameter is larger than the diameter of the through hole 41 and which accommodates a piston 43 thus forming the under-piston and above-piston chambers designated, respectively, by numbers 44 and 45. The cross-sectional area of the piston 43 is larger than the area of the shoulder 36.

The piston 43 is in constant contact with the face of the extension 37. The under-piston chamber 44 is vented to the atmosphere through a channel 46 in the liner and through a channel 47 made coaxially with the channel 46 in the cover 48 of the body 28, said cover being secured by any known means. The above-piston chamber 45 communicates hydraulically with the control element 25 of the shutoff valve 24 of any known design through a channel 49 made in the liner 40, a channel 50 made in the body 28 coaxially with the channel 49, and through a pipe connection 51. The control element 25 communicates through a pipe connection 52 with the channel 31 of the valve 24. There are also known means (not shown in FIG. 2) for shutting off the pipe connection 52. The control element 25 communicates with the low pressure hydraulic line 9 through a pipe connection 53.

As has already been stated above, the distributor 18 (FIG. 1) comprises limit switches 26 and 27 which connect the control element 25 of the shutoff valve 24 with the rod 21 of the pneudralic cylinder 17 and are installed at the extreme positions of the free end of the rod 21, the connection between the control element 25 and the limit switches 26 and 27 being of any suitable type.

It is practicable that the drive of the hydraulic screw press according to the claimed layout should incorporate the inlet and discharge valves 15 and 16 of the same design as the shutoff valve 24, and the chamber of the inlet valve 15 should communicate with the chamber "A" of the power cylinder 6 through the longitudinal channels of the closing element. This will reduce the time for actuating the power cylinder 6 and thus diminish the losses of energy accumulated by the pneudraulic accumulator 7 and, consequently, increase the press efficiency; besides, it will cut down greatly the time of contact between the dies and the workpiece being pressed which will improve considerably the quality of the product and reduce the wear of the tool.

OPERATING PRINCIPLE

The pneumatic chamber of the pneudraulic accumulator is charged as follows.

The above-piston pneumatic chamber 23 (FIG. 1) of the pneudraulic cylinder 17 is put in communication with the pneumatic line 8 through the nonreturn valve 19*a* and simultaneously the motor of the pressure source 10 is turned on. The gas is delivered under pressure from the pneumatic line 8 into the above-piston pneumatic chamber 23, moving the piston 20 with the rod 21 of the pneudraulic cylinder 17 to the right (in the plane of drawing in FIG. 1) to the extreme right position. Then the valve 19*a* closes. Meanwhile the under-piston hydraulic chamber 22 is in communication with the low-pressure hydraulic line 9 through the shutoff valve 24. The free end of the rod 21 acts on the limit switch 27 and the latter sends a signal to the control element 25 which results in that the fluid is delivered through the control element 25 (FIG. 2), pipe connection 51 and channels 50 and 49 into the above-piston chamber 45. The fluid pressure moves the piston 43 down; it presses on the extension 37 and shifts down the closing element 34 which comes onto the seat 33 thereby closing the valve 24.

The chamber 29 communicating with the hole 32 through the longitudinal channels 39 is also filled with fluid which exerts identical pressure on both faces of the closing element 34. Inasmuch as, according to the invention, the area of the piston 43 is larger than that of the shoulder 36, the force acting on the piston 43 is larger than the force acting on the shoulder 36. This ensures tight contact of the closing element 34 with the seat 33. The valve 24 is reliably closed whereas the inlet valve 15 (FIG. 1) and the discharge valve 16 are also closed. Simultaneously with the closing of the shutoff valve 24 the fluid flowing from the source of pressure 10 enters the under-piston hydraulic chamber 22 of the pneudraulic cylinder 17. The fluid pressure moves the piston 20 with the rod 21 to the left (in the plane of the drawing in FIG. 1) and forces the gas from the above-piston pneumatic chamber 23 through the nonreturn valve 19*b* into the pneumatic chamber 7*b* of the pneudraulic accumulator. The accumulator 7 is thus charged with gas. Having reached the extreme left position, the rod 21 interacts by its free end with the limit switch 26. The latter sends a signal to the control element 25 (FIG. 2) of the shutoff valve 24. Its above-piston chamber 45 (FIG. 2) is put in communication with the low-pressure hydraulic line 9 through the control element 25 and channel 53. The pipe connection 52 is closed in any known way. As a result, pressure drops in the above-piston chamber 45. The fluid is fed through the channel 31 into the circular recess 30 and to the shoulder 36. Under the effect of the pressure applied to the shoulder 36, the closing element 34 moves upward together with the piston 43. The shutoff valve 24 opens.

The under-piston hydraulic chamber 22 (FIG. 1) and the pressure source 10 communicate through the opened shutoff valve 24 with the low-pressure hydraulic line 9 and the pressure in the chamber 22 decreases. Acted upon by the pressure of gas flowing from the pneumatic line 8 through the nonreturn valve 19*a* into the above-piston chamber 23, the piston 20 with the rod 21 of the pneudraulic cylinder 17 moves to the right (in the plane of the drawing in FIG. 1). On reaching the extreme right position the free end of the rod 21 interacts with the limit switch 27.

In the course of subsequent charging of the pneudraulic accumulator 7 the cycle is repeated just as it is described above until the required gas pressure is built up in the pneudraulic accumulator.

After the pneudraulic accumulator has been charged with gas, its hydraulic chamber 7*b* is charged with fluid from the source of pressure 10. Thus, the drive is ready to operate the hydraulic screw press which functions as follows.

The hydraulic chamber 7*b* of the pneudraulic accumulator 7 is put in communication through the inlet valve 15 with the chamber "A" of the power cylinder 6. The barrel 11 of the power cylinder 6 together with the slide 2 is subjected to the pressure in chamber "A" and due to the not self-locking thread performs helical downward motion, towards the blank "B" located on the bottom die 5. The die set interacts with the blank "B" and shapes a part.

Then the chamber "A" of the power cylinder 6 is put in communication with the low-pressure hydraulic line 9 through the discharge valve 16. The barrel 11 of the power cylinder 6 together with the slide 2 is returned by the cylinder 14 (FIG. 1) to the initial (uppermost) position.

In the course of pressing the next blank the working cycle of the press is repeated over again.

What is claimed is:

1. A drive of a hydraulic screw press comprising: a source of pressure; a low-pressure hydraulic line; a pneumatic line; a power cylinder whose movable member is connected with a press slide of the screw press; a pneudraulic accumulator comprising a hydraulic chamber communicating with said pressure source and a pneumatic chamber; an inlet valve; the power cylinder having a chamber communicating with the hydraulic chamber of said pneudraulic accumulator through said inlet valve; a discharge valve through which said chamber of the power cylinder communicates with said low-pressure hydraulic line; means for charging the pneumatic chamber of said pneudraulic accumulator comprising a pneudraulic cylinder with a piston, a distributor, and nonreturn valves; the pneudraulic cylinder of said means for charging the pneumatic chamber of said pneudraulic accumulator comprises a hydraulic under-piston chamber communicated alternately through the distributor with said pressure source and said low-pressure hydraulic line, and an above-piston pneumatic chamber communicated alternately through the nonreturn valves respectively with said pneumatic line and the pneumatic chamber of the pneudraulic accumulator.

2. A drive according to claim 1 wherein the distributor comprises a shutoff valve with a control element and limit switches connecting said control element with the rod of the pneudraulic cylinder and installed at the extreme positions of the free end of said rod.

3. A drive according to claim 2 wherein the shutoff valve comprises: a body; a chamber in said body; a closing element accommodated in said chamber; a circular shoulder located on the external surface of said closing element; longitudinal channels made in said closing element; an extension of said closing element; a liner located in said chamber of the body, above said extension and provided with holes arranged coaxially with the closing element, one of said holes being of the through type to allow for the passage of said extension while the other hole has the form of a chamber accommodating a piston installed with a provision for constant contact with said extension so that the thus formed above-piston chamber is communicated hydraulically with the control element of the shutoff valve while the under-piston chamber is vented to the atmosphere.

4. A drive according to claim 3 wherein said extension of the shutoff element has a cross-sectional area smaller than that of its circular shoulder and the latter is smaller than the area of the piston of the shutoff valve.

* * * * *